United States Patent [19]

Starck

[11] Patent Number: 4,990,748

[45] Date of Patent: Feb. 5, 1991

[54] APPARATUS FOR HEATING GASES

[75] Inventor: Roland Starck, Bellheim, Fed. Rep. of Germany

[73] Assignee: Fritz Eichenauer GmbH & Co. KG, Kandel, Fed. Rep. of Germany

[21] Appl. No.: 337,084

[22] Filed: Apr. 12, 1989

[30] Foreign Application Priority Data

Jan. 26, 1989 [DE] Fed. Rep. of Germany ..... 3902206

[51] Int. Cl.[5] ..... F24H 7/00; H05B 1/00; H05B 3/02

[52] U.S. Cl. ..... 392/485; 219/504; 361/383

[58] Field of Search ..... 219/365, 539, 541, 553, 219/544, 548, 504, 505; 338/22; 361/383, 388, 389

[56] References Cited

U.S. PATENT DOCUMENTS

| | | | |
|---|---|---|---|
| 4,147,927 | 4/1979 | Pirotte | 219/537 |
| 4,162,395 | 7/1979 | Kobayashi | 219/537 |
| 4,327,282 | 4/1982 | Nauerth | 219/549 |

*Primary Examiner*—Roy N. Envall, Jr.
*Attorney, Agent, or Firm*—Antonelli, Terry, Stout & Kraus

[57] ABSTRACT

An apparatus for heating gases, particularly air, with a heating unit having a mounting part, at least one PTC component, at least one insulating frame part surrounding the latter, at least one contact plate and at least one insulating support. The PTC component is surrounded by the frame part being inserted in the mounting part and on at least one flat side rests a contact plate and is covered by an insulating support. Heat emission lamellas are mounted in a clamping manner on the heating unit to ensure an effective heat emission to the surrounding air or gas.

22 Claims, 2 Drawing Sheets

APPARATUS FOR HEATING GASES

BACKGROUND OF THE INVENTION

The invention relates to an apparatus for heating gases, particularly air, with a heating unit having a mounting part, at least one PTC component, at least one insulating frame part surrounding the latter, at least one contact plate and at least one insulating support, with the PTC part, surrounded by the frame part, being placed in the mounting part and a contact plate rests on at least one flat side and is covered by an insulating support.

Such heating apparatuses have been be known in the form of wire heaters and tubular heaters. In the case of gas heaters the heating wires are lead freely over long distances, so that air and a gas can flow between them and can be heated. In the case of tubular heaters the heating wire placed inside a tube is embedded in an insulating material. To heat air or gas, the tubes must be provided with heat emission lamellas. This is in part brought about in that the lamellas are constructed in one piece with the tube jacket. Alternatively use, is made of slotted tubes, which are pressed by expansion against mounted lamellas, so as in this way to provide a firm connection. The actual tubular heater being inserted in the expanded, slotted tube. The winding round tubular heaters in part takes place by coiling. According to another construction the tubular heater is formed by profile sheet metal strips, which are interconnected by folded seams and as ribs extending longitudinally of the tubular heater project laterally therefrom. As in this case the ribs are not at right angles to the tubular heater axis, only an unsatisfactory heat emission is obtained. According to another tubular heater construction for air heating purposes, lamellas extending at right angles to its axis are welded to an outer jacket, which is subsequently pressed onto a ceramic part containing the heating wires by pressing in or firmly rolling. It has finally also been proposed to surround the tubular heater with a coating shaped in one piece with the ribs.

For some time now self-stabilizing heaters have been provided with PTC components as the heat producing element. Unlike in the case of resistance heaters, which produce the heat as a result of the power applied and their substantially constant resistance, in the case of PTC components the production of heat is dependent on their temperature, dropping with higher temperature and is consequently dependent on how effectively the initially produced heat is removed. PTC components have hitherto been used for heating liquids or solids, such as soldering irons and curlers.

The aim the invention is to provide an apparatus for heating gases, particularly air, of the aforementioned type with a PTC component as the heating element, which ensures an effective emission of heat to the air or a gas surrounding the apparatus, so that an adequate heating power is obtained.

According to the invention, an apparatus of the aforementioned type is characterized in that heat emission lamellas are mounted in clamping manner on said heating unit.

As a result of the inventive construction a heating unit based on a PTC component can be provided with heat emission lamellas, which are on the one hand reliably secured so as to ensure an adequate heat removal from the actual heating unit to the heat emission lamellas and from there to the surrounding air, while at the same time adequately compensating dimensional changes occurring as a result of the temperature changes, so that permanently a firm seating of the heat emission lamellas on the heating unit is ensured. This is further improved in that the compressive force of the heating unit against the heat emission lamellas is naturally reinforced on raising the temperature. In a preferred development, the inventive apparatus for heating gases is constructed in such a way that the lamellas have openings surrounding the heating unit and which are bounded by two facing tongues bent out of the plane of the lamellas and which have a spacing in their connection area with respect to the lamella bodies corresponding to the height of the heating unit, while the internal spacing of the ends of the tongues is smaller than the height of the heating unit. This construction leads to a simple and preferred clamp fit, which ensures the aforementioned advantages.

According to a further development, the lamellas have grooves or creases, which are in particular directed at right angles to the tongues. The construction stabilizes the heat emission lamellas and, in particular, prevents a fluttering or oscillating thereof when air passes through, particularly if it is forced through the lamellas by convection. The prevention of lamellas oscillation avoids the noise produced as a result thereof.

In a preferred manner, the mounting part is constructed as a U-profile. On the insulating support, which is generally made from relatively break-sensitive material, such as metal oxides, are placed cover plates, so that the tongues of the lamellas on the one hand engage directly on said cover plates and on the other hand on the web of the U-profile and the two press against one another, accompanied by the interposing of insulating plates and the PTC component. The lamellas, mounting part and cover plate are preferably made from aluminium or an aluminium alloy, such as in particular spring hard aluminium with a hardness of F28 and with thermal stability of over 400° C.

PTC components are preferably surrounded on their narrow sides by a frame part, which has transverse webs, which keeps the PTC components spaced. The insulating support is preferably formed from individual insulating plates, whose width corresponds to the frame width and whose length substantially corresponds to that of the PTC components, plus the transverse web width of the frame part, so that the insulating support parts are longitudinally linked to one another. The coverage of the cover plates substantially corresponds to the insulating supports. As a result of this subdivision of the cover plates and insulating supports in accordance with the PTC components, a good pressing action is achieved by the pressed on lamellas over the length of the individual portions.

According to a preferred development, the apparatus has a holding part for PTC components with an insulating frame and at least one contact plate, in which the latter is firmly connected to the insulating frame. In order to ensure a reliable hold of the PTC components during handling, it is not sufficient to have an insulating frame surrounding the narrow sides of the PTC components because, even if a substrate is held against the same from below, e.g. in the form of a contact plate, there is a risk of the insulating frame and substrates sliding relative to one another, so that once again a single PTC component can fall out of the frame. According to this further development, the contact plate and the insulating frame are firmly interconnected. The term firmly interconnected here means that they cannot be detached without considerable effort and in particular that they cannot be loosened from one another by chance or slide relative to one another. It would fundamentally also be possible to use a screw coupling. However, preferably the contact plate is riveted in the vicinity of one of its ends to the insulating frame. The firmly fitted contact plate is positioned on one side of the frame, so that the individual PTC components can be inserted in the frame part from the opposite side and are prevented from dropping out by the contact plate. The further contact element, such as a further plate or a profile contact body with a U-shaped cross-section can then be placed on the side of the frame and the inserted PTC components facing the contact plate firmly connected to the frame. It is then possible to position further cover elements, such as stable cover plates or the like which protect the insulating member up to the time of further assembly, namely the optional placing of insulating plates on the contact plate. According to a further development, of the holding part, a connecting tongue is riveted to the contact plate and/or a contact tongue is constructed in one piece with the contact plate. If the contact plate is already firmly connected to the insulating frame, it is then also apropriate to construct in one piece therewith a connecting tongue, namely, that connected to the contact plate and/or to firmly connect it, e.g. by riveting to the insulating frame.

If a relative pivoting of frame and contact plate could also be prevented by two rivets, which are either juxtaposed in one end region or are in each case located at one end region, then it is advantageous to prevent pivoting of that end of the contact plate which is not firmly connected to the insulating frame and also to prevent any bending out of its plane, but not to completely fix the same, so that the end can perform compensating movements, e.g. under compressive forces and temperature changes. In order to achieve this, according to another preferred development, on the end of the insulating frame opposite to the fixed connection between the contact plate and the insulating frame is formed a clip raised out of the plane thereof and which engages over the contact plate end opposite to the fixing point and in particular the contact plate is free between its end region.

In order to prevent a giving way or yielding of the contact plate under compressive forces exerted during the further assembly of a PTC heater, to ensure a good heat transfer and therefore to obtain the same, according to a preferred development the contact plate is made from flexible sheeting. It is then preferred that the contact plate is bent in convex manner and pretensioned with respect to the frame part. As a result in the case of locally exerted forces, i.e. not exerted over the entire length of the frame and contact plate and which essentially act in the central region, an adequate pressing action is obtained and therefore a sufficiently good contact between the contact plate and the PTC components over the entire length.

According to a further development in the vicinity of the fixing point ofn the frame side facing the contact plate are provided cams extending out of the plane thereof. It is thus possible to prevent an axial displacement of insulating plates resting on the contact plate side remote from the frame. According to another construction the frame has transverse webs. As a result the individual PTC components can be individually grasped and received in recesses within the frame part.

BRIEF DESCRIPTION OF THE DRAWINGS

The invention is described in greater detail hereinafter relative to non-limitative embodiments and the attached drawings, wherein.

DETAILED DESCRIPTION

Figure 1:
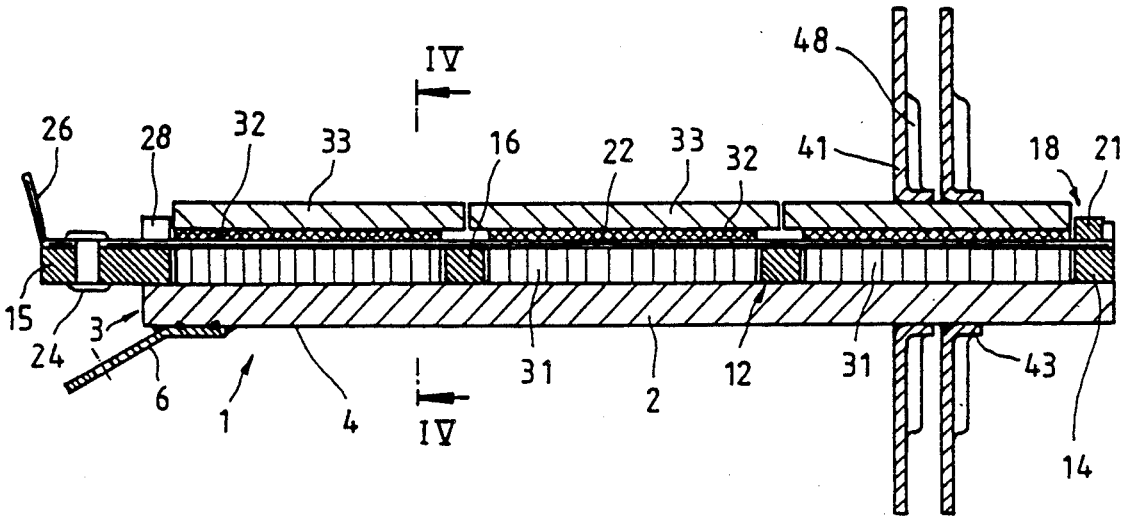
FIG. 1 is a vertical longitudinal section through a heating device taken along the line I—I in FIG. 4.

The heating device generally designated by the reference numeral 1 has an aluminium U-profile 2, which preferably has a hardness F28 and a thermal stability over 400° C. A connecting tongue 6 is fixed, e.g. riveted or spot welded to the outer wall 4 of one end 3 of the U-profile 2.

Figure 2:
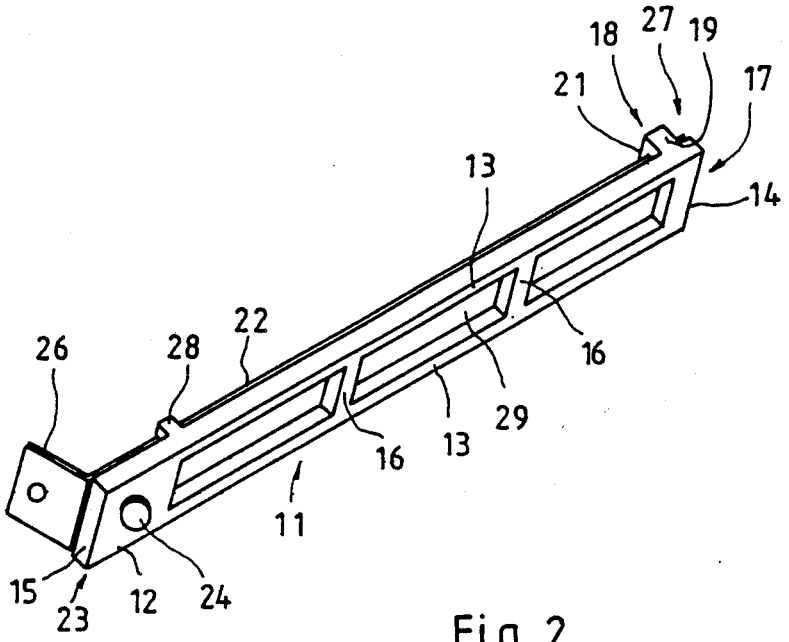
FIG. 2 is a perspective view of a holding part for PTC components, such as is used in the heating device according to FIG. 1.
Figure 4:
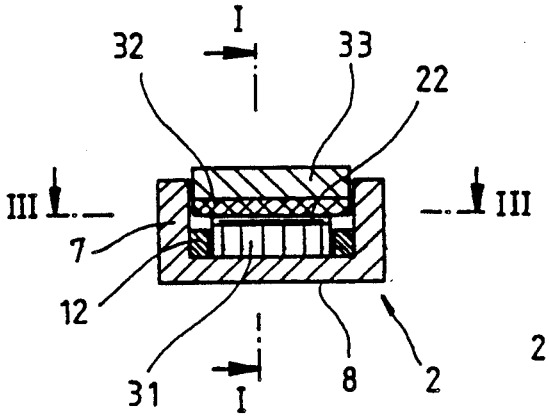
FIG. 4 is a vertical cross-section taken along the line along IV—IV in FIG. 1.
Figure 3:
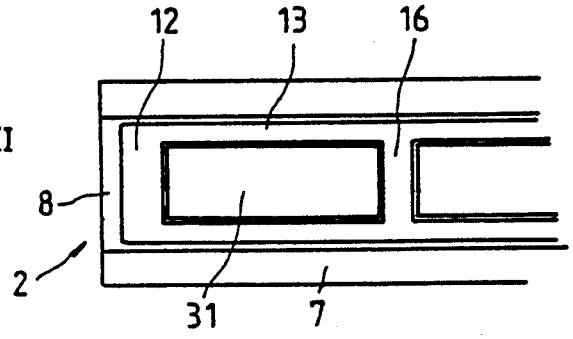
FIG. 3 is a cross-section through the device taken along the line III—III in FIG. 4.

A holding part generally designated by the reference numeral 11, as shown in detail in FIG. 2 is located in the U-profile 2. The holding part generally designated by the reference numeral 11 has a frame part 12 made from an insulating material, such as Rayton. The frame part 12 is formed from longitudinal legs 13, transverse legs 14, 15 constructed on the end faces thereof and also, in the represented embodiment, from transverse webs 16. To one end face generally designated by the reference numeral 17, it also has a U-shaped clip generally designated by the reference numeral 18 raised out of its plane and which is constructed with its legs 19 in one piece on the longitudinal legs 13 of frame part 12, while web 21 extends at right angles over the width of frame part 12, over which extends a contact plate 22. In the represented embodiment the contact plate 22 is constructed as a spring plate. In the end region 23 of frame part 12 remote from the end face 17 it is firmly connected thereto, e.g. rivetted thereto by a rivet 24. It is simultaneously possible to rivet a further connecting tongue 26. The connecting tongue could be constructed in one piece with the contact plate 22. On its end face 27 remote from connecting tongue 26, contact plate 22 engages under web 21 of the clip 18 and is thus held by the latter at the end 27. Contact plate 22 is preferably prebent in convex manner towards frame 12 and, consequently, pretensioned. In the vicinity of its end 23 and on the same side facing contact plate 23 on which clip 18 is located, frame 12 has on its two longitudinal legs 13 two cams 28, which, in the longitudinal direction to the contact plates, longitudinally secure between the cams 28 and the clip 18 insulating parts placed on its side remote from the frame. PTC components 31 (FIGS. 1, 3, 4) are inserted in the recesses 29 of frame 12 bounded by legs 13, 14, 15 and webs 16. Individual insulating parts 32 forming an insulating support are placed on contact plate 22. Insulating parts 32 have a length corresponding to the PTC components 31. Their width corresponds to the internal spacing of legs 7 of U-profile 2. The insulating parts are preferably made from a heat conducting, electrically insulating metal oxide, such as e.g. magnesium, barium or, preferably, aluminium oxide. Insulating parts 32 also carry stable cover plates 33, e.g. made from aluminium, whose width and length correspond to the width and length of insulating parts 32. The height of the arrangement formed by PTC components 31, contact plate 22 and insulating part 32 is slightly below the internal length of leg 7 of U-profile 2, while the height of the aforementioned parts, plus the height of the cover plate 33, is slightly above the said internal length of leg 7.

Figure 5:
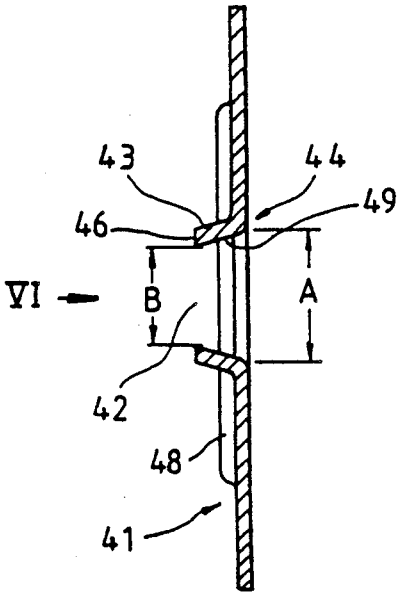
FIG. 5 is a section through a lamella taken along the line V—V in FIG. 6.
Figure 6:
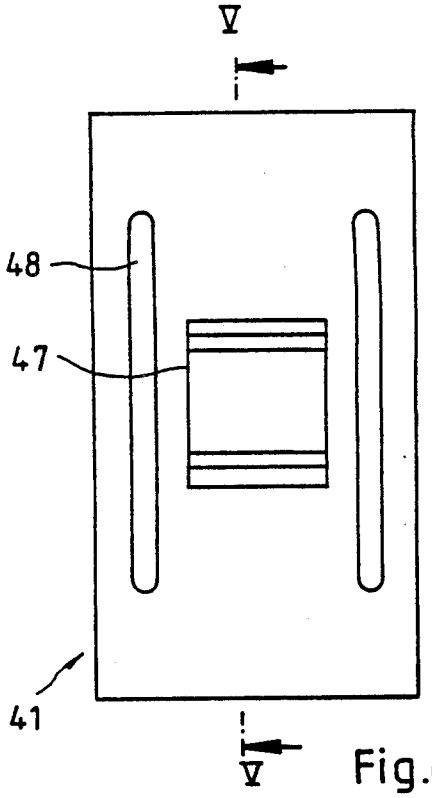
FIG. 6 a view of a lamella taken in a direction of the arrow VI in FIG. 5.

The aforementioned heating unit carries in frictionally engaging manner lamellas 41 for delivering heat to the surrounding air or gas. For this purpose the lamellas 41 have an opening 42, which is inter alia defined by two facing tongues 43, which are bent out of the main plane of the lamellas 41. In the transition region generally designated by the reference numeral 44 (FIG. 5) of tongues 43 to the main part of lamellas 41, the spacing A (FIG. 5) thereof is at least the height of the heating unit of leg 8 of U-profile 2, a PTC component 31, contact plate 22, insulating part 32 and cover plate 33, while the internal spacing B of end faces 46 of tongues 43 is below the height of the aforementioned arrangement and therefore less than spacing A, for as long a lamella 41 is not moved over the above-defined heating unit. The lamellas 41 are made from aluminium sheeting. For reinforcement purposes, the lamellas 41 have reinforcing grooves 48 running parallel to the longitudinal edges 47 and which are stamped out of the main plane of lamellas 41. This leads to a slight increase in the heat delivery surface, but it is important that said reinforcement ensures that the lamellas 41 do not flutter when air flows through, which could lead to noise being produced. Thus, the lamellas 41 are passed in frictionally engaging manner over the heating unit and rest thereon under clamping engagement. Due to the fact that, apart from the individual PTC components 31, also the insulating plates 32 and cover plates 33 are constructed in split manner, lamellas 41 lead to a good thermal contact between the PTC components 31 and on the one hand leg 8 of U-profile 2 and on the other, via contact plate 22, with the insulating part 32 and the cover plates 33 located above it. As a result of the clamp fit the side 49 of tongues 43 facing the heating unit is pressed substantially flat against the top of cover plate 43 or the outside of leg 8 and engage on the parts, so that a reliable heat transfer to the lamellas and a delivery of heat to the air are ensured. The tongues 46 bent out of the plane of the lamellas 41 ensure a spacing of the lamellas 41 from one another, i.e. they form spacers, which avoids close engagement between the lamellas 41. A clearly defined relative spacing is maintainted between them. Whereas only two lamellas 41 located on the heating unit are shown in FIG. 1, in fact numerous such lamellas 41 are juxtaposed thereon, so that a radiator with a plurality of lamellas 41 is formed.

The overall arrangement is assembled as follows. First the holding part 11 constituted by frame part 12 and contact plate 22 are firmly interconnected by rivetting of the two parts and simultaneous rivetting of the connecting tongue 26. The PTC components 31 are then inserted in frame part 12 from the side remote from contact plate 22 and are held by contact plate 22 firmly connected to frame part 12, so that it is not possible for them to drop out. The sectionally U-shaped profile is then placed on the side of frame part 12 remote from contact plate 22. The inside of its web 8 engages with PTC components 31 and legs 7 engage laterally over the frame 12, particularly its longitudinal leg 13 and cover plate 22. The unit is then turned by 180°, so that web 8 of profile part 2 is directed downwards and now carries holding part 11 and the PTC components in frame 12, while legs 7 project over holding part 11 in the upwards direction. Between legs 7, on contact plate 22 are placed the insulating plates 32 and on the latter the cover plates 33. Lamellas 4 are then engaged on the resulting unit and as a result of the clamping sides thereof they bring about a firm arrangement, which can no longer fall apart.

I claim:

1. Apparatus for heating gases with a heating unit having a mounting part, at least one PTC component inserted in the mounting part, at least one insulating frame surrounding the at least one PTC component, at least one contact plate and at least one insulating support, the at least one contact plate resting on at least one flat side and being covered by the at least one insulating support, and heat emission lamellas resting in a clamping manner on said heating unit , said lamellas including openings surrounding the heating unit said openings being bounded by two facing tongues bent out of a plane of the lamellas, wherein a connection area of the two tongues to a body of the respective lamellas are spaced at a distance corresponding to a height of the heating unit, and wherein an internal spacing of ends of the respective tongues is less than the height of the heating unit.

2. Apparaatus according to claim 1 wherein the lamellas are provided with reinforcing grooves.

3. Apparatus according to claim 2, wherein said grooves are directed at right angles to the tongues.

4. Apparatus according to one of claims 1 or 2, wherein the mounting part has a U-shaped profile.

5. Apparatus according to one of claims 1 or 2, further comprising cover plates resting on the at least one insulating support.

6. Apparatus according to claim 5, wherein at least one of the mounting part, cover plates and lamellas are made from one of aluminium and an aluminium alloy.

7. Apparatus according to one of claims 1 or 2, wherein the at least one insulating support is formed from metal oxide.

8. Apparatus according to one of claims 1 or 2, wherein the at least one insulating frame part is made from Rayton.

9. Apparatus according to one of claims 1 or 2, wherein the at least one frame is an insulating frame.

10. Apparatus, according to claim 1, wherein the at least one contact plate is firmly connected to the at least one insulating frame.

11. Apparatus according to claim 10, wherein the at least one contact plate is riveted to the at least one insulating frame in a fastening area of an end face thereof.

12. Apparatus according to claim 11, wherein at least one connecting tongue is riveted to the at least one contact plate.

13. Apparatus according to one of claims 10 or 11, wherein at least one connecting tongue is constructed in one piece with the at least one contact plate.

14. Apparatus according to one of claims 10 or 11, wherein an end of the at least one insulating frame opposite to the fastening area between the at least one contact plate and the at least one insulating frame is formed as a clip raised out of a plane thereof and engageable over the end of the at least one contact plate opposite to the fastening area.

15. Apparatus according to one of claims 10 or 11, wherein the at least one contact plate is free between end regions thereof.

16. Apparatus according to one of claims 10 or 11, wherein the at least one contact plate is made from flexible sheet metal.

17. Apparatus according to one of claims 10 or 11, wherein the at least one contact plate is bent in a convex manner with respect to the at least one frame and pretensioned.

18. Apparatus according to one of claims 10 or 11, wherein cam means extending out of a plane of the at least one frame are provided in a vicinity of the fastening area on a side of the at least one frame facing the at least one contact plate are provided cams.

19. Apparatus according to one of claims 1 or 10, wherein the at least one includes transverse webs.

20. Apparatus according to one of claims 1 or 2, wherein at least two PTC components are arranged between the at least one insulating support and the lamellas, and wherein cover plates are provided corresponding in number corresponds to a number of the PTO components and having a shape adapted thereto.

21. Apparatus according to one of claims 1 or 2, wherein at least two PTC components are provided , and wherein the at least one insulating support comprises insulating parts corresponding in number to a number of the PTC components and whose having a shape adapted thereto.

22. Apparatus according to one of claims 1 or 2, wherein at least two PTC components are provided, and wherein the at least one contact plate comprises parts corresponding in number to a number of the PTC components and adapted to the shape thereof.

* * * * *